United States Patent [19]

Pflaum et al.

[11] 4,051,778

[45] Oct. 4, 1977

[54] ROLLER DEVICE FOR USE WITH PRESSURE SENSITIVE DUPLICATING MASTER AND METHOD OF OPERATION

[75] Inventors: William D. Pflaum; Mark E. Tullis, both of Dayton, Ohio

[73] Assignee: The Mazer Corporation, Dayton, Ohio

[21] Appl. No.: 700,208

[22] Filed: June 28, 1976

[51] Int. Cl.[2] ..... B41L 11/00

[52] U.S. Cl. ..... 101/133; 101/269; 101/468

[58] Field of Search ..... 101/269, 131, 130, 133, 101/252, 256, 257, 260, 264, 274, 186, 189, 146, 56, 113, 468; 100/210

[56] References Cited

U.S. PATENT DOCUMENTS

| | | | |
|---|---|---|---|
| 555,653 | 3/1896 | Millert | 101/133 |
| 1,801,594 | 4/1931 | Dugdale | 101/274 |
| 1,979,811 | 11/1934 | Reardon | 101/133 |
| 2,013,259 | 9/1935 | Wagner | 101/133 |
| 2,982,205 | 5/1961 | Maul | 101/269 |

FOREIGN PATENT DOCUMENTS

| | | | |
|---|---|---|---|
| 3,818 | 9/1879 | United Kingdom | 101/133 |

*Primary Examiner*—Clifford D. Crowder
*Attorney, Agent, or Firm*—Biebel, French & Nauman

[57] ABSTRACT

A device for applying pressure to a pressure sensitive duplicating master and a sheet of copy paper positioned on a hard surface includes two rollers of differing hardness. The rollers are used simultaneously with the harder roller applying substantial duplicating pressure while the softer roller conforms to irregularities in the hard surface and prevents these irregularities from causing voids in the duplicated image.

6 Claims, 5 Drawing Figures

ROLLER DEVICE FOR USE WITH PRESSURE SENSITIVE DUPLICATING MASTER AND METHOD OF OPERATION

BACKGROUND OF THE INVENTION

The present invention relates to duplicating equipment and more particularly to a hand-held dual roller device for applying pressure to a pressure sensitive duplicating master and a method of duplication using the device. In order to produce copies from this type of duplicating master, the master and a sheet of copy paper are placed on a hard surface with the side of the duplicating master bearing the printing ink next to the copy paper. The duplicating master and copy paper are pressed together to transfer the image from the master to the face of the copy paper.

It is known in the art to apply the pressure required for duplication to a master by means of a roller device. U.S. Pat. No. 555,653, issued Mar. 3, 1896, to Millert, shows a hand-held roller device having two metallic rollers journalled in the ends of pivotally mounted bars. The pivoting arrangement is said to permit the roller device to follow the contour of a book in which a copy is to be imprinted. It is significant that both rollers in this device are metal and apparently function in the same manner.

Other roller devices, having dual rollers, are shown in U.S. Pat. No. 274,549, issued Mar. 23, 1883 to Baldwin; and U.S. Pat. No. 2,610,580, issued Sept. 16, 1952 to Burke. Both the Burke and Baldwin devices have dual roller arrangements in which it is contemplated that the rollers will not be used simultaneously. Both devices have one roller which is used to apply water or other solvent prior to copying. The second roller is used subsequently to apply pressure during the copying process.

U.S. Pat. No. 3,090,301, issued Mar. 21, 1963 to Arounowa, shows a device for manually transferring a pattern which is marked in dye on a pattern roller. A second roller is used to supply solvent to either the pattern roller or to the surface on which the pattern is to be printed such that pattern transfer will be made. In one embodiment of the Arounowa device, the solvent roller is used to apply solvent to the surface to be imprinted just ahead of the transfer roller. There is no suggestion in this reference, however, of using the device for pressure sensitive duplicating.

It is desirable when using a pressure sensitive duplicating master to apply uniform pressure over the entire master since image transfer is dependent solely upon pressure applied to the master. If a hard rubber or metal roller is used to apply pressure to the pressure sensitive duplicating master and the copy paper, irregularities in the surface upon which the master and copy paper rest may result in voids in the duplicated image. Such voids may also occur if the roller is irregularly shaped. Thus, it is seen, there is a need for a means for applying pressure to a pressure sensitive duplicating master and copy paper which will result in clear copies being produced, regardless of slight irregularities in the surface upon which the duplicating master and copy paper rest.

SUMMARY OF THE INVENTION

A device for applying pressure to a pressure sensitive duplicating master and a sheet of copy paper positioned on a hard surface includes a first means for applying pressure to the duplicating master and copy paper. Additionally a second means, substantially more deformable than the first means, is provided for applying pressure to the duplicating master and copy paper. A frame means for mounting the first and second means is provided such that pressure may be applied simultaneously by the first and second means whereby the first means applies substantial duplicating pressure to the master and the second means deforms sufficiently to conform to irregularities in the hard surface upon which the master and copy paper are placed.

Copies are produced by placing the reverse printed side of a pressure sensitive duplicating master, having an image reverse printed in duplicating ink, in contact with a sheet of copy paper on a hard surface. A duplicating pressure is then applied simultaneously with rollers of differing hardness.

The frame means may advantageously include a handle. First and second means for applying pressure may each comprise rubber coated rollers which are mounted for rotation with respect to the frame means. The roller comprising the first means for applying pressure has a hardness level in the range of 70–80 while the roller comprising the second means for applying pressure has a hardness level in the range of 50–60.

Accordingly, it is an object of the present invention to provide a pressure application device and method for applying pressure to a pressure sensitive duplicating master and copy paper such that printing defects due to surface irregularities are minimized; to provide such a device and method in which means differing in hardness coact with the duplicating master and copy paper; and to provide such a device and method in which two rubber rollers of differing hardness apply pressure simultaneously.

Other objects and advantages of the invention will be apparent from the following description, the accompanying drawings, and the appended claims.

DETAILED DESCRIPTION OF THE INVENTION

Figure 1:
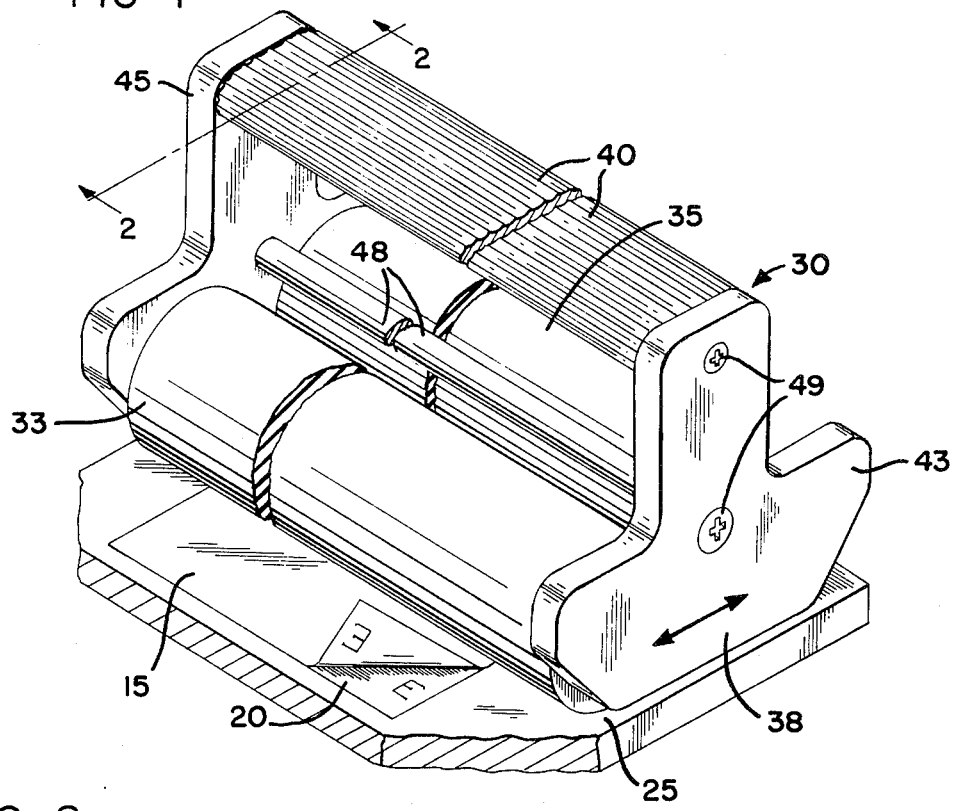
FIG. 1 is a perspective view showing the present invention in use.

Referring now to FIG. 1 of the drawings, an embodiment of the present invention for applying pressure to a pressure sensitive duplicating master and copy paper is shown in perspective. Such a master is described more fully in co-pending U.S. Patent Application Ser. No. 596,597, filed July 17, 1975 and assigned to the assignee of the present invention, now abandoned. The master 15 has one side reverse printed in duplicating ink comprising a dye in vinyl resin dispersion which is then heated to the gel point. The master with the gelled image material is placed adjacent a sheet of copy paper 20 such that the reverse printed side is in contact with the copy paper. Pressure is applied to the master and copy paper while they are positioned on a hard surface 25 by the roller device 30 of the present invention. The pressure causes dye to exude from the porous structure of the vinyl material and transfer to the copy sheet.

A first pressure roller means 33 of predetermined hardness, and having a central axis about which it may be rotated, is provided for applying pressure to the duplicating master 15 and copy paper 20. Additionally, a second pressure roller means 35, having a central axis about which it may be rotated, is provided having a hardness which is less than the predetermined hardness of the first roller means. The second roller means 35 is therefore substantially more deformable than the first roller means 33. A frame means 38 mounts the first roller means 33 and the second roller means 35 side by side with their respective axes substantially parallel and laterally displaced and permits pressure to be applied with rollers 33 and 34 simultaneously to the duplicating master 15 and copy paper 20. The frame means includes a handle 40 and reinforcing rod 48 which extend between first and second mounting means including end pieces 43 and 45. The handle 40 and rod 48 are attached to end pieces 43 and 45 by machine screws 49. Roller means 33 and 35 each comprise a rubber cover roller mounted for rotation with respect to the frame means 38.

Figure 2:
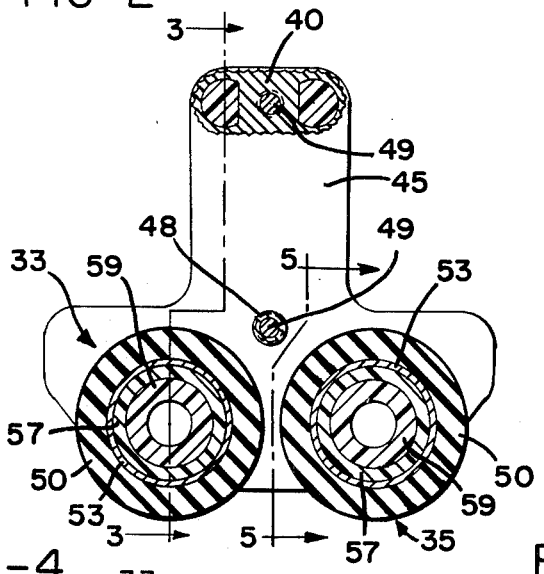
FIG. 2 is a sectional view taken generally along line 2—2 in FIG. 1.
Figure 3:
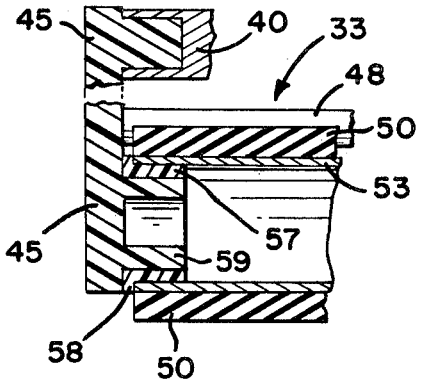
FIG. 3 is a partial sectional view taken generally along line 3—3 in FIG. 2.

FIG. 2 is a sectional view taken generally along line 2—2 in FIG. 1. Each roller comprises a layer of rubber or similar resilient material 50 covering a stiff tube 53 which may be made of aluminum. Plastic inserts 57 positioned at each end of tubes 53 are provided to facilitate rotation of the rollers 33 and 35 and to prevent tubes 53 from bearing directly on end pieces 43 and 45. Inserts 57 surround raised cylindrical portions 59 which are formed integrally in the end pieces. There is sufficient clearance between cylindrical portions 59 and inserts 57 such that rollers 33 and 35 may be rotated freely. As shown in FIG. 3, insert 57 include flange portions 58 which prevent contact between tubes 53 and the end pieces.

Figure 4:
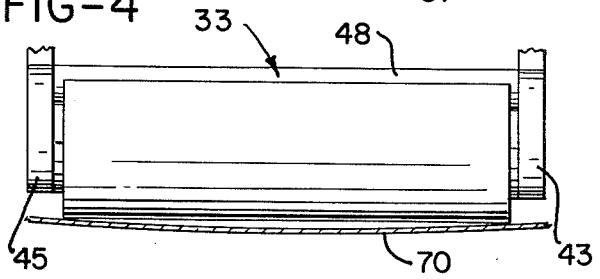
FIG. 4 is a view looking left to right in FIG. 2.
Figure 5:
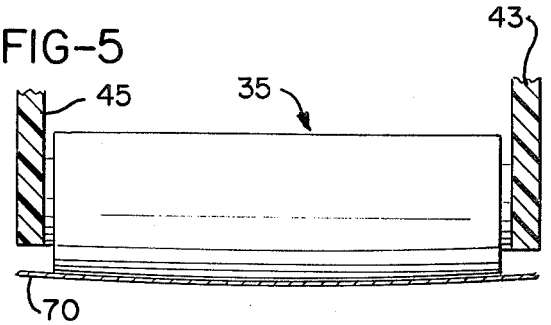
FIG. 5 is a sectional view taken generally along line 5—5 in FIG. 2.

Referring now to FIG. 4, a view looking left to right in FIG. 2, and FIG. 5, a sectional view taken generally along line 5—5 in FIG. 2, the manner in which pressure is applied to a duplicating master and copy paper is illustrated. Typically the present invention will be used by placing the duplicating master and copy paper on a desk top or other hard surface. Surfaces of this sort, while generally flat, may have slight irregularities which can adversely affect the quality of copies produced thereon. The present invention allows copies of high quality to be made on such an irregular surface.

The present invention compensates for irregularities in the surface upon which the copies are made by using two rollers of differing hardness to apply the pressure needed for copying. The softer roller used in the present invention may advantageously have a hardness level in the range of 50–60. The harder roller may advantageously have a hardness level in the range of 70–80. As used herein, "hardness level" refers to a measurement taken with a standard Shore type A-2 durometer gauge. The measurement is taken after applying the gauge to the surface of the roller assembly for one second. The hardness level is measured on the assembled roller rather than the resilient roller covering material since this level will be affected by the metal tube in the center of the roller.

As shown in FIG. 4, since roller means 33 is relatively hard, it will not readily change shape to conform to a warped surface 70. A duplicating master would be forced into contact with copy paper only at the ends of roller means 33 if roller 33 were used by itself. The resulting copy would not be of good quality since the central portion of the material would not be duplicated. By using roller 35 with roller 33, however, the voids resulting from such an uneven surface are substantially eliminated. As seen in FIG. 5, roller 35 is of a hardness less than that of roller 33 and, therefore, is substantially more deformable than roller 33. Roller 35 conforms to the shape of surface 70 and thus all areas of the duplicating master receive at least some duplicating pressure.

It should be understood that roller 35, if used alone to apply pressure to the master, would result in unacceptably light copies. This is because, since there is more roller area in contact with the master than with a harder roller, the force per unit area applied by this roller is less than that applied by a roller of greater hardness.

While the form of apparatus and method herein described constitute a preferred embodiment of the invention, it is to be understood that the invention is not limited to this precise form of apparatus and method, and that changes may be made therein without departing from the scope of the invention.

What is claimed is:

1. A device for use with a pressure sensitive duplicating master for applying a duplicating pressure to the master and a sheet of copy paper positioned with the master on a hard surface comprising:

first roller means of a predetermined hardness for applying pressure, said first roller means having a central axis about which it may be rotated, second roller means, of a hardness less than said predetermined hardness, for applying pressure, said second roller means having a central axis about which it may be rotated, and frame means for mounting said first and second roller means side by side with their respective axes substantially parallel and laterally displaced and for permitting pressure to be applied simultaneously with said first and second roller means, whereby the quality of the copy produced is not adversely affected by irregularities in the hard surface since both said first roller means and said second roller means apply duplicating pressure to all portions of the master and the sheet of copy paper.

2. The device of claim 1 in which said frame means includes a handle.

3. The device of claim 1 in which said first and second roller means each comprise a rubber covered roller mounted for rotation with respect to said frame means.

4. The device of claim 3 in which said first roller has a hardness level in the range of 70–80 and said second roller has a hardness level in the range of 50–60.

5. A device for applying pressure to a pressure sensitive duplicating master and a sheet of copy paper positioned on a hard surface comprising:

frame means, having first and second laterally displaced mounting means, first pressure means, mounted on said frame means and extending between said first and second mounting means, for applying pressure to the duplicating master and copy paper, and second pressure means, substantially more deformable than said first pressure means, mounted on said frame means and extending between said first and second mounting means, for applying pressure to the duplicating master and copy paper, whereby pressure may be applied simultaneously by said first and second means with substantial duplicating pressure applied to said master and copy paper by said first pressure means and uniform pressure applied by said second pressure means as it deforms sufficiently to conform to irregularities in the hard surface upon which said master and copy paper are placed.

6. A method of producing printed copies from a pressure sensitive duplicating master having an image reverse printed in duplicating ink on one side thereof, comprising the steps of:

placing the reverse printed side of the pressure sensitive duplicating master in contact with a sheet of copy paper, placing the duplicating master and the copy paper together on a hard surface, and applying duplicating pressure simultaneously with rollers of differing hardness levels, which rollers each extend entirely across the master and copy paper, such that irregularities in said hard surface do not adversely affect the quality of the image transferred to said copy paper.

* * * * *